US005722553A

United States Patent [19]

Hovatter

[11] Patent Number: 5,722,553

[45] Date of Patent: Mar. 3, 1998

[54] INTEGRAL ASSEMBLY OF MICROCENTRIFUGE STRIP TUBES HAVING INDEPENDENTLY TETHERED ANGULARLY RELATED SEAL CAPS

[76] Inventor: Kenneth P. Hovatter, 1901 Ackerman Dr., Lodi, Calif. 95240

[21] Appl. No.: 414,191

[22] Filed: Mar. 31, 1995

[51] Int. Cl.[6] ..... B65D 85/00

[52] U.S. Cl. ..... 220/23.8; 220/375

[58] Field of Search ..... 220/375, 23.8

[56] References Cited

U.S. PATENT DOCUMENTS

| | | | |
|---|---|---|---|
| 2,949,203 | 8/1960 | Berg | 220/23.8 X |
| 2,992,501 | 7/1961 | Douglas | 220/23.8 |
| 3,139,208 | 6/1964 | Irwin et al. | 220/23.8 |
| 3,382,969 | 5/1968 | Cerniak | 220/23.8 X |

*Primary Examiner*—Steven M. Pollard
*Attorney, Agent, or Firm*—John J. Leavitt; George M. Cooper

[57] ABSTRACT

Presented is an integral assembly (2) of hollow tubes and seal caps (16) therefor arranged in an elongated aligned and integral assembly in which multiple tubes (1) each symmetrical about a longitudinal axis (3) and having a closed end (12) and an open end (6) are formed in side-by-side spaced relationship in a linear series in which adjacent tubes are integrally interconnected by a tether (13) to form an elongated strip (2). A multiplicity of seal caps (16) corresponding in number to the aligned series of tubes are independently, angularly and integrally flexibly connected to associated tubes. The seal caps, when in tube-open condition, are each symmetrical about an axis (17) parallel to the axes of the tubes and correspond in spacing and in number to the tubes. A hinge strap (14) is provided integrally interposed between each tube and the associated seal cap. Each seal cap may independently be manipulated into superimposed sealing relationship with the associated tube, the axis of the seal cap coinciding with the axis of the tube and the seal caps may be pressed independently into sealingly engagement with the open end of the associated tubes.

18 Claims, 2 Drawing Sheets

INTEGRAL ASSEMBLY OF MICROCENTRIFUGE STRIP TUBES HAVING INDEPENDENTLY TETHERED ANGULARLY RELATED SEAL CAPS

BACKGROUND OF THE INVENTION

1. Field of the Invention

This invention relates to hollow strip tubes closed at one end and open at the opposite end and caps independently tethered to the tubes for selectively sealing and unsealing the open ends of selected tubes, such as microcentrifuge tubes, for instance, and more particularly to an integral aligned assembly of such strip tubes and caps independently tethered to associated tubes in an angular relationship to enable independent sealing or unsealing of individual tubes without altering the status of the remaining tubes.

2. Description of the Prior Art

A preliminary patentability and novelty search in connection with this invention has revealed the existence of the following U.S. Pat. Nos.:

D-288,845 D-271,619 D-269,702
D-332,145 D-226,846 D-325,638
D-321,940 D-316,449 4,675,299
4,671,939 4,472,357 4,639,135
3,905,772 4,648,713 5,005,721
5,110,556

A careful review of these patents has failed to disclose or suggest the concept of, or disclose or suggest a structural assembly of, multiple integrally connected hollow strip tubes serially arranged in alignment with independent caps integrally tethered angularly to each associated tube in the elongated strip of integrally connected tubes for selective independent sealing of each tube when each cap is independently superimposed over the tube to which it is angularly tethered. It is particularly advantageous in the handling of reagent-containing vials or tubes, such as microcentrifuge tubes, that the tubes and the independently tethered caps for sealing the tubes constitute a unitary assembly. Accordingly, it is one of the objects of the present invention to provide a unitary assembly of multiple hollow tubes integrally connected to one another and to a corresponding number of seal caps independently tethered to an associated tube so that the integral assembly of tubes and caps may be handled as a unit while enabling each of the seal caps to be independently sealed or unsealed from the tube to which it is independently integrally tethered.

Another object of the invention is the provision of a unitary assembly of tubes and caps integrally connected and with the caps independently integrally tethered to associated tubes in an angular relationship to minimize the overall width of the tube and cap assembly.

A still further object of the invention is the provision of a unitary assembly of tubes and caps integrally connected and arranged serially in two straight lines when the caps and tubes are in tube-open condition, each cap being independently integrally tethered to an associated tube and spaced from and unconnected with associated caps.

A still further object of the invention is the provision of an integral assembly of a strip of hollow tubes having open ends and independent seal caps integrally tethered angularly to the tubes and adapted to selectively independently seal the open ends of the associated tubes when brought into superimposed relationship therewith and wherein the caps in tube-open condition constitute a plurality of linearly aligned independent caps tethered integrally to associated tubes, with an integral "live" hinge integrally interposed in the tether connecting each tube to the angularly associated cap enabling flexible manipulation of each independent cap by its hinge from an angularly related integral extended condition to an integral superimposed tube-sealing condition.

Yet another object of the invention is the provision of an integral assembly of a multiplicity of reagent tubes in aligned strip form, each tube in the assembly being independently tethered flexibly to a seal cap so that any one or a number of the tubes may be separated from the others to create a sub-assembly of integral tubes with independently tethered seal caps flexibly attached thereto.

The invention possesses other objects and features of advantage, some of which, with the foregoing, will be apparent from the following description and the drawings. However, the invention is not limited to the embodiment illustrated and described since it may be embodied in various forms within the scope of the appended claims.

SUMMARY OF THE INVENTION

In terms of broad inclusion, the integral assembly of hollow tubes and seal caps therefor comprises an elongated assembly in which multiple tubes each symmetrical about a longitudinal axis and having a closed end and an open end are formed in side-by-side spaced relationship in a linear series in which adjacent tubes are integrally interconnected to form an elongated strip. Each individual tube in the strip of tubes is provided with an independent integrally tethered seal cap angularly related to the tube to which it is tethered so that the group of caps when in tube-open condition constitute a linear series of spaced seal caps, each cap symmetrical about an axis parallel to the axis of the tube to which it is angularly tethered, and corresponding in spacing and in number to the tubes. The axes of the strip tubes are parallel and coincident with a common plane. The axes of the caps are parallel and coincident with a common plane parallel to the plane including the axes of the tubes when the caps are in tube-open condition. When the caps are in tube-sealed condition the axes of the caps and tubes are coincident with a common plane. A hinge means is provided integrally interposed between each tube of the tube strip and each cap whereby each cap may be independently manipulated into superimposed relationship to the associated tube to which it is angularly tethered. Because of the angular relationship of each cap with its associated tube, the axis of the seal cap and the axis of the associated tube to which it is tethered are parallel when in tube-open condition and are coincident in a plane that is angularly disposed to the plane coincident with the axes of the aligned tubes at an angle other than 90 degrees to the common plane within which the axes of the tubes are coincident.

DESCRIPTION OF THE PREFERRED EMBODIMENT

Figure 1:
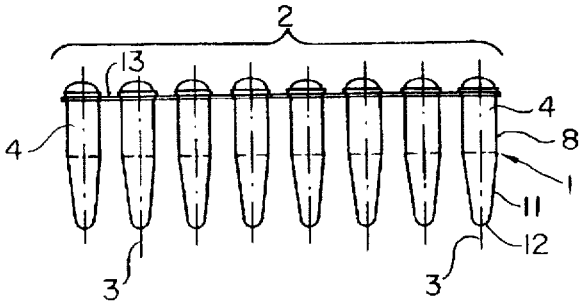
FIG. 1 is a side elevational view shown actual size of the complete assembly of integral strip tubes and independently integrally tethered seal caps shown in tube-closed condition to illustrate the small size of the assembly of eight tubes and caps.

In terms of greater detail, the integral assembly of microcentrifuge strip tubes and independent angularly tethered integral caps facilitates all of the functions involved in the handling and use of such tubes, and therefore saves time, resulting in increased efficiency and greater production. The importance of the flexible integrality of the assembly with respect to facilitating handling will be readily apparent when it is understood that the overall length of each tube is less than one inch, while the inner diameter of the open end of each tube is less than one quarter inch. It is difficult to digitally manipulate such a small individual tube, and it has been found that connecting multiple such tubes into an integral assembly, including the seal caps, greatly facilitates handling. Where each tube is provided with an independent angularly tethered integral seal cap, greater convenience is achieved because it enables each tube to be selectively independently sealed or unsealed without altering the condition of the other tubes and their caps.

Structurally, the integral assembly comprises a multiplicity, say eight or more, of microcentrifuge or other reagent tubes, injection molded from a suitable plastic, each tube in the assembly designated generally by the numeral 1, and the entire integral assembly of multiple tubes designated generally as an assembly by the numeral 2. Each of the tubes is hollow and symmetrical about a central axis 3, is identical to each of the other tubes, and includes an upper cylindrical body portion 4 defined by an open end 6. Exteriorly, the open end of each tube is surrounded by an integral concentric collar 7 constituting an annular flange projecting radially outwardly from and integral with the cylindrical outer surface 8 of the body portion 4. As shown in the drawings, the collar 7 forms a relatively narrow annular band about the open end of the associated tube. The upper annular surface 9 of the annular band forms a seal surface. A sense of the small and delicate nature of the tube structure is derived when it is understood that the remainder of the cylindrical body portion 4 is about half the entire length of the tube and only about 0.375" long measured parallel to the central axis of the tube.

Below the upper cylinderical body portion 4, the tube is tapered inwardly as at 11 for the remainder of its length of about 0.375", terminating in a generally rounded closed end 12 as illustrated in the drawings.

Each of the tubes thus formed is integrally connected to an adjacent tube to form an integral linear assembly or series 2 of tubes as illustrated in FIGS. 1, 2, 3 and 4, that are collectively arranged symmetrically so that their axes are parallel and contained in a common plane PT that bisects the tubes. The integral connection between adjacent tubes is formed by a strap or tether 13 that is also bisected by the common plane PT coincident with the longitudnal axes of the tubes. Since the linear series of eight tubes from center-to-center of the end tubes is only about 2.5 inches, it will be appreciated that each tether or strap 13 is less than 0.10" in length and approximately one half that amount in width. It is obvious therefore that the tether strap 13 forms the only connection between adjacent tubes and that its width is about one-fifth the diameter of the associated open end of the tube. Since the tethers are all the same length, and since the tubes are all the same diameter, it follows that the longitudinal axes 3 of the adjacent tubes are equally spaced one from the other, this spacing being about 0.357 inches.

Figure 2:
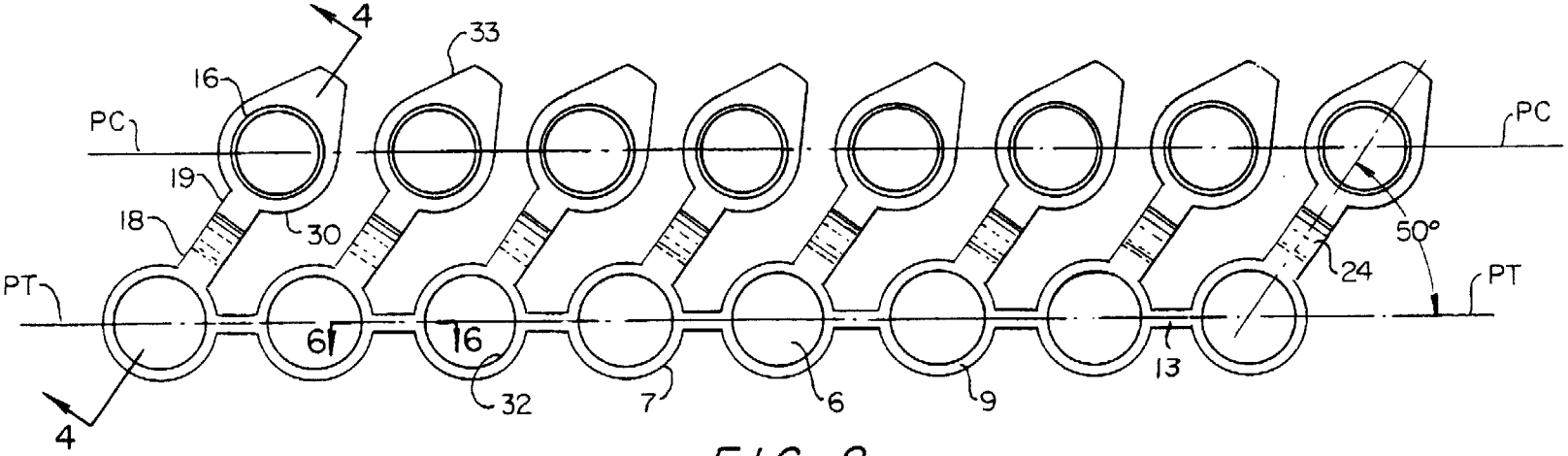
FIG. 2 is a top plan view of the complete assembly shown greatly enlarged for clarity and shown with the seal caps in tube-open condition.
Figure 3:
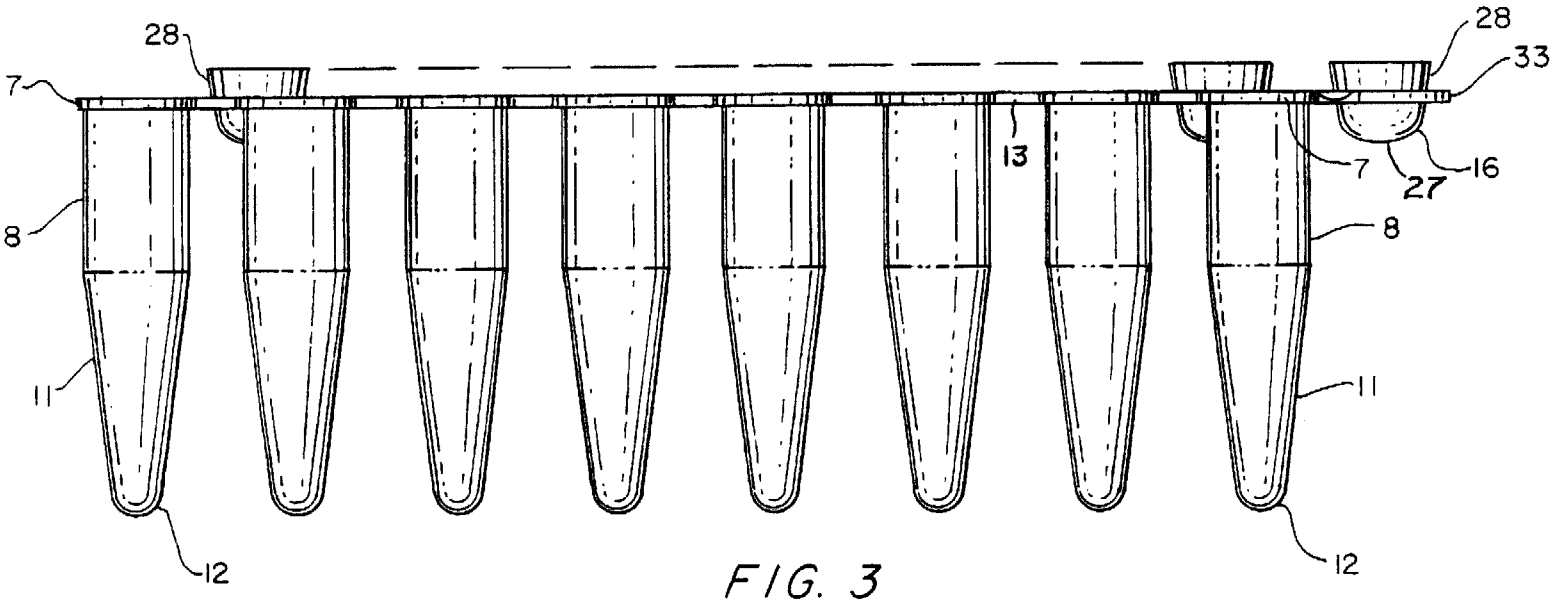
FIG. 3 is a side elevational view of the complete assembly shown greatly enlarged for clarity and shown with the seal caps in tube-open condition.

As illustrated in FIG. 2 of the drawings, each tube of the integral and linear assembly of tubes is integrally connected independently by a flexible hinge strap designated generally by the numeral 14 to an angularly associated seal cap, each cap being designated generally by the numeral 16. As shown, there are as many seal caps as there are tubes, and each seal cap is formed about a central axis 17. In the tube-open or extended arrangement illustrated in FIG. 2, the central axes of the tubes are coincident with plane PT, and the central axes of the seal caps are parallel to one another and coincident with plane PC. As shown in FIG. 2, planes PT and PC are parallel and laterally spaced apart approximately 0.375 inches.

As illustrated in the drawings, each hinge strap 14 at one end 18 merges integrally with the periphery of the collar 7 of the adjacent tube of the integral linear assembly of tubes. At its opposite end 19, each hinge strap 14 merges integrally with the associated seal cap 16 of the series of independent seal caps. It should be noted that the flexible hinge straps, the integrally connected tubes, and the seal caps are all preferably formed as a single unitary structure by injection molding from a suitable synthetic resinous material. It is also important to note that the thickness of the flexible hinge strap 14 measured between its upper surface 21 and its lower surface 22 is less than the width of the collar 7, and that the lower surface 22 is flush with the lower surface 23 of the collar 7, and that the upper surface 21 of the hinge strap is spaced below the top surface 9 of the collar 7. Nevertheless, because the dimensions are so small, it is considered that the open ends of the tubes, including the collar 7 and the hinge straps, are coincident in a common horizontal plane.

Figure 4:
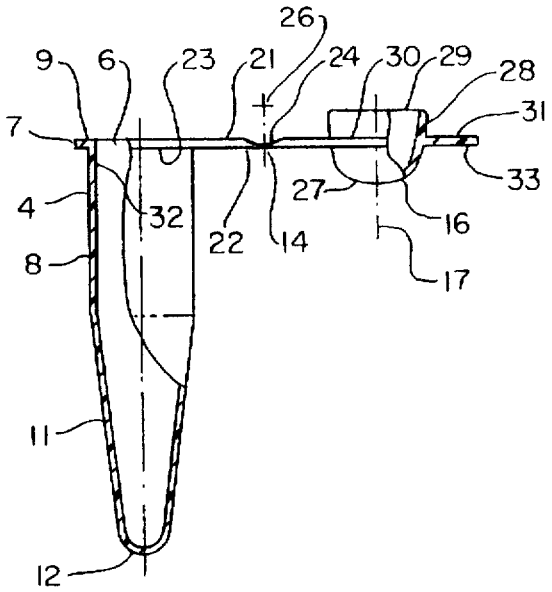
FIG. 4 is a vertical cross-sectional view through one of the tubes and its associated angularly tethered seal cap and illustrating the manner of flexible integral interconnection of the tube to the cap. The view is taken in the plane indicated by the line 4—4 in FIG. 2, and shown greatly enlarged for clarity.

Medianly between the ends of each hinge strap, the hinge strap is thinned in thickness in a portion 24 to increase the flexibility of the hinge strap. Preferably, the thinned portion 24 is arcuate about a point 26 spaced above the flexible hinge strap as shown in FIG. 4. The radius of curvature of the arcuate portion 24 is conveniently sufficient to reduce the thickness of the portion 24 to about 0.019 inches. The thinned portion 24 thus constitutes a so-called "live" hinge about which each seal cap of the serially arranged independent seal caps may be independently pivoted to bring each of the seal caps independent of other seal caps into a superimposed relationship with a correspondingly positioned tube as illustrated in the drawings. By "live" hinge, it is meant that the thin hinge portion is integral with the remainder of the strap with which it is integrally formed, yet is so flexible that it will readily flex so that the strap portions on opposite sides of the "live" hinge lie superimposed one above the other in substantial parallelism when the seal cap is in tube-closed condition.

Figure 5:
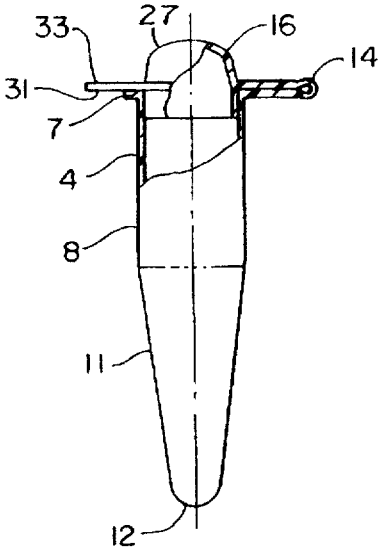
FIG. 5 is a fragmentary enlarged elevational view illustrating the flexible integral hinge means integrally interconnecting a tube to a seal cap, the hinge means shown flexed over to effect sealing superimposition of the seal cap within the open end of the associated tube.
Figure 6:
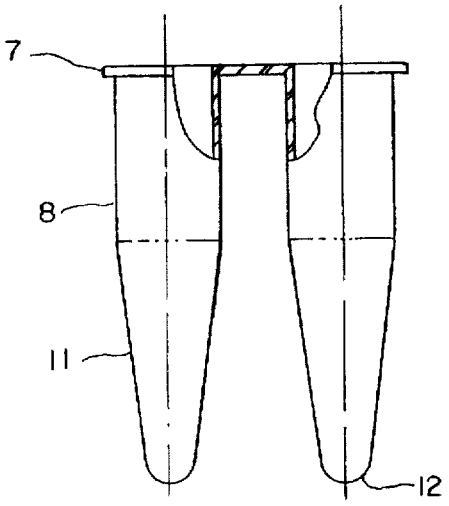
FIG. 6 is an enlarged fragmentary cross-sectional view taken in the plane indicated by the line 6—6 in FIG. 2, and illustrating the integral interconnection between adjacent tubes.

To effect a seal between each of the individual seal caps and its associated tube to which it is independently, angularly and integrally tethered, it is important to note from FIG. 4 of the drawings that each seal cap is provided with a semi-spherically configured end wall 27 that merges smoothly into a slightly flared tubular wall portion 28, the diameter of the open end edge 29 of which is slightly greater than the opening of the associated tube so that when the flared tubular portion of the cap is pressed into the open end of the tube, the flared portion 28 is slightly elastically compressed and is thus retained in tube-sealing position as shown in FIG. 5.

Again as illustrated in FIG. 4, it will be seen that on the opposite end of the hinge strap from the tube and flange 7 surrounding the open end of the tube, each seal cap is provided with a circumscribing flange 30 the flat annular inner surface 31 of which extends radially outwardly from the tubular flared wall portion at the point of its union with the semi-spherical domed portion 27 of the seal cap. The hinge strap for the seal cap is angularly related between the associated tube and the seal cap, and is integrally connected to the periphery of the flange 30 at an angle of about 50 degrees from the plane PT that is coincident with the axes of the tubes. Thus, by virtue of the outwardly tapered or flared configuration of the "skirt" portion 28, the diameter of end edge 29 of the flared skirt portion that defines the open end of each of the seal caps is somewhat larger than the inner diameter of the open end of each of the tubes. Stated in other Words, the outer diameter of the open end 29 of each seal cap is related to the inner diameter of the open end 6 of each associated tube in a manner so that when a seal cap is superimposed over the open end of a tube, pressure applied on the semi-spherical end wall 27 of the seal cap causes a camming action to occur between these two surfaces that results ultimately in the skirt portion being elastically compressed radially inwardly until a sealing press-fit occurs between the outer flared surface of the skirt portion and the cylindrical inner surface 32 of the tube. When each seal cap is fully sealingly engaged as shown in the drawings in the open end of its associated tube, the length of the skirt portion 28 of the seal cap and the depth of the seal surface 32 within the tube are such that the end edge 29 of the skirt portion 28 lies confined within the limits of the cylindrical seal surface. To unseal a seal cap from its associated tube, the circumscribing flange 30 is provided on its periphery diametrically opposite its attachment to the hinge strap with a tab portion 33 that may be digitally manipulated to lift the seal cap and open the tube. The tab projects slightly beyond the peripheral edge of flange 7 for this purpose. In tube-closed condition of the seal cap, the upper annular seal surface 9 of the tube is contiguous with the annular seal surface 31 of the seal cap.

Having thus described the invention, what is believed to be new and novel and sought to be protected by letters patent of the United States is as follows.

I claim:

1. An integral assembly of a multiplicity of spaced reagent tubes arranged in an elongated aligned series, said tubes each having an open end and a closed end, the open ends of adjacent tubes integrally connected by a series of aligned tethers, and a corresponding multiplicity of correspondingly spaced independent seal caps, each seal cap having a tubular seal skirt portion symmetrical about a central axis and adapted to selectively sealingly engage the open end of an associated reagent tube, each said seal cap being independently pivotally connected integrally and angularly to an associated one of said reagent tubes at an angle other than 90 degrees to the elongated aligned series in which said reagent tubes are arranged and independently selectively manipulable in relation to the open end of said associated reagent tube to superimpose said seal cap thereover to selectively effect sealing penetration of said tubular skirt portion into or out of said open end to seal or unseal the open end of said associated reagent tube.

2. The integral assembly according to claim 1, wherein said multiplicity of spaced integrally connected reagent tubes are each symmetrical about a central axis and arranged in an elongated uninterrupted strip no wider than the diameters of said reagent tubes and in which the axes of the multiplicity of tubes are parallel to one another, equally spaced apart, and coincident with a common plane.

3. The integral assembly according to claim 2, wherein said multiplicity of independent seal caps when in tube-open position are aligned in a common plane parallel to and spaced from the plane coincident with the axes of said tubes.

4. The integral assembly according to claim 3, wherein said multiplicity of independent seal caps are tethered to said associated tubes at an angle other than 90 degrees to the plane coincident with the axes of said tubes.

5. The integral assembly according to claim 2, wherein the open ends of said multiplicity of reagent tubes lie in a common plane.

6. The integral assembly according to claim 5, wherein tether means coincident with the plane of said open ends of the multiplicity of tubes integrally interconnect adjacent tubes.

7. The integral assembly according to claim 6, wherein said tether means is coincident with the plane including the central axes of said multiplicity of spaced reagent tube.

8. The integral assembly according to claim 7, wherein each of said reagent tubes is elongated in the direction of its central axis and includes a cylindrical seal portion adjacent its open end, an annular flange disposed integrally about said cylindrical seal portion and defining the open end of said tube, said tether means integrally connecting the annular flanges of adjacent reagent tubes, and a cylindrical seal surface within the open end of each reagent tube concentrically disposed in relation to said annular flange and adapted to elastically sealingly compress said seal skirt on an associated seal cap when the seal skirt is pressed into the open end of the associated reagent tube.

9. The integral assembly according to claim 5, wherein a flexible hinge integrally and pivotally interconnects each tube to an associated seal cap, each said flexible hinge extending from the tube to which it is integrally connected at an angle other than 90 degrees, each said flexible hinge being connected to said tube in the plane common to said open ends of the tubes.

10. The integral assembly according to claim 1, wherein a flexible hinge strap is integrally interposed between each said reagent tube and each said associated seal cap, one end of said hinge strap being integral with the tube adjacent its open end and the opposite end of the hinge strap being integral with the associated seal cap, said hinge strap including a flexible thinned portion intermediate its opposite ends adapted to accommodate superimposition of the hinge strap portions on opposite sides of the flexible thinned portion when said seal cap is manipulated into superimposed sealed relation with said reagent tube to which the seal cap is integrally tethered.

11. The integral assembly according to claim 10, wherein each said reagent tube is provided with an integral collar surrounding the open end thereof, and said hinge strap is integrally connected at one end to said collar and is integrally connected at its opposite end to the adjacent seal cap medianly between opposite ends thereof, whereby said seal cap may selectively and independently be digitally manipulated into superimposed tube-sealed position relative to said reagent tube.

12. The integral assembly according to claim 8, wherein each said reagent tube includes a cylindrical wall portion coincident at one end with said open end of the tube, and an inwardly tapered conical wall portion integral with said cylindrical wall portion at one end and closed at its opposite end.

13. The integral assembly according to claim 8, wherein said cylindrical body portion of each tube includes a cylindrical inner peripheral seal surface adjacent said open end, whereby said skirt portion of an associated seal cap is cammed into elastic compression when sealingly inserted into said cylindrical seal surface.

14. The integral assembly according to claim 13, wherein said seal caps each include an open end and a closed end, said open end facing the direction in which the open ends of said tubes face when said end caps are extended laterally in tube-open relation with said assembly of reagent tubes.

15. An integral assembly of a multiplicity of spaced integrally connected reagent tubes arranged in an elongated series, each tube having an open end and a closed end, and a corresponding multiplicity of correspondingly spaced independent seal caps, each seal cap having a seal skirt portion symmetrical about a central axis and adapted to selectively sealingly engage the open end of an associated reagent tube, each said seal cap being independently pivotally connected integrally and angularly to an associated one of said reagent tubes and independently selectively manipulable in relation to the open end of said associated reagent tube to superimpose said seal cap thereover to selectively seal or unseal the open end of said associated reagent tube, said multiplicity of spaced integrally connected reagent tubes each being symmetrical about a central axis and arranged in an elongated uninterrupted strip in which the axes of the multiplicity of tubes are parallel to one another, equally spaced apart and coincident with a common plane, and wherein the open ends of said multiplicity of reagent tubes lie in a common plane, tether means coincident with the plane of said open ends of the multiplicity of tubes integrally interconnecting adjacent tubes, said tether means being coincident with the plane including the central axes of said multiplicity of spaced reagent tubes; each said reagent tube being elongated in the direction of its central axis and including a cylindrical seal portion adjacent its open end and an annular flange disposed integrally about said cylindrical seal portion and defining the open end of said tube, said tether means integrally connecting the annular flanges of adjacent reagent tubes, and a cylindrical seal surface within the open end of each reagent tube concentrically disposed in relation to said annular flange and adapted to elastically sealingly compress said seal skirt on an associated seal cap when the seal skirt is pressed into the open end of the associated reagent tube, said cylindrical body portion of each tube including an inner peripheral seal surface adjacent said open end, whereby said skirt portion of an associated seal cap is cammed into elastic compression when sealingly inserted into said cylindrical seal surface, said seal caps each including an open end and a closed end, said open end facing the direction in which the open ends of said tubes face when said end caps are extended laterally in tube-open relation with said assembly of reagent tubes, each said seal cap including a semi-spherically domed wall portion constituting said closed end and a cylindrical open end integral with said skirt portion, said skirt portion including a truncated conically tapered wall portion that flares radially outwardly to the open end of said seal cap.

16. The integral assembly according to claim 15, wherein the outside diameter of the open end of said skirt portion on each seal cap is greater than the inner diameter of the open end of the reagent tube, whereby when a seal skirt portion is pressed into the open end of an associated reagent tube, the differential in diameters effects elastic compression of said skirt portion to seal the open end of the associated reagent tube.

17. An integral assembly of a multiplicity of spaced reagent tubes arranged in an elongated aligned series to form an elongated strip, said tubes each having an open end and a closed end, the open ends of adjacent tubes integrally connected directly by a series of aligned tethers, and a corresponding multiplicity of correspondingly spaced independent seal caps, each seal cap having a seal skirt portion symmetrical about a central axis and adapted to selectively sealingly engage the open end of an associated reagent tube, each said seal cap being independently pivotally directly connected integrally and angularly to an associated one of said reagent tubes and independently selectively manipulable in relation to the open end of said associated reagent tube to superimpose said seal cap thereover to selectively effect sealing penetration of said seal skirt portion of said seal cap into or out of said open end to seal or unseal the open end of said associated reagent tube, wherein said integral and angular connection of each saaid seal cap directly to an associated reagent tube is effected at other than 90 degrees to the elongated series into which said multiplicity of tubes are arranged.

18. The integral assembly according to claim 17, wherein said aligned tethers that integrally connect adjacent reagent tubes possess a width less than the diameters of the associated reagent tubes whereby said tethers comprise the only interconnection between said reagent tubes.

* * * * *